US007223250B2

(12) United States Patent
Brattesani et al.

(10) Patent No.: US 7,223,250 B2
(45) Date of Patent: May 29, 2007

(54) INTEGRATED REMOTE CONTROL AND MASSAGE DEVICE

(76) Inventors: Steven J. Brattesani, 3309 Fillmore St., Marina District, San Francisco, CA (US) 94123-2170; Bruce S. McLean, 12091 S. Millridge Rd., Sandy, UT (US) 84094

( * ) Notice: Subject to any disclaimer, the term of this patent is extended or adjusted under 35 U.S.C. 154(b) by 0 days.

(21) Appl. No.: 10/692,472

(22) Filed: Oct. 23, 2003

(65) Prior Publication Data

US 2005/0090768 A1 Apr. 28, 2005

(51) Int. Cl.
*A61H 1/00* (2006.01)

(52) U.S. Cl. ..... 601/46; 601/47; 601/70; 601/72

(58) Field of Classification Search ..... 601/46–49, 601/56–60, 70, 72
See application file for complete search history.

(56) References Cited

U.S. PATENT DOCUMENTS

| | | | | |
|---|---|---|---|---|
| 5,161,879 | A * | 11/1992 | McDermott | 362/206 |
| 5,857,985 | A * | 1/1999 | Feng | 601/47 |
| 6,027,463 | A * | 2/2000 | Moriyasu | 601/46 |
| 6,236,621 | B1 * | 5/2001 | Schettino | 368/10 |
| 6,535,125 | B2 * | 3/2003 | Trivett | 340/539.13 |
| 6,573,854 | B1 * | 6/2003 | Hug et al. | 341/176 |

FOREIGN PATENT DOCUMENTS

CA 2440780 * 9/2004

OTHER PUBLICATIONS

Voice-activated remote control advertisement, p. 40, Discovery Channel Store catalog, (at least earlier than Oct. 23, 2003).

Rechargeable Handheld & Cordless Massager advertisement, p. 33, Discovery Channel Store catalog, (at least earlier than Oct. 23, 2003).

The Infrared Penetrating Massager advertisement, p. 6, Hammcher Schlemmer & Co. catalog, (at least earlier than Oct. 23, 2003).

Pedicure Foot Salon advertisement, p. 31, Discovery Channel Store catalog, (at least earlier than Oct. 23, 2003).

Blissful Foot Massager advertisement, p. 30, Discovery Channel Store catalog, (at least earlier than Oct. 23, 2003).

Total Foot Massager with Heat advertisement, p. 15, Sharper Image catalog, (at least earlier than Oct. 23, 2003).

(Continued)

*Primary Examiner*—Michael A. Brown
(74) *Attorney, Agent, or Firm*—John P. O'Banion

(57) ABSTRACT

An integrated remote control and massage device includes a housing having at least one massage surface, a remote control input interface for enabling a user to control at least one electronic entertainment device, and at least one motor that selectively provides vibrating motion to the massage surface(s). The integrated device enables control of devices such as a television, an audio system, a video disc player, a video cassette recorder, a direct broadcast satellite receiver, a personal video recorder, a cable box, and a digital portable music and/or entertainment system. In addition, the device may be used as a vibrating massage device. The device may optionally include a heating element, a sound recorder, a device locator, or a flashlight.

24 Claims, 10 Drawing Sheets

OTHER PUBLICATIONS

Never Lose the Remote Control Again! Advertisement, p. 7, unknown catalog, (at least earlier than Oct. 23, 2003).
Largest Universal Remote advertisement, p. 23, unknown catalog, (at least earlier than Oct. 23, 2003).
Thumper Mini Pro II Massager advertisement, p. 50, Sharper Image catalog, (at least earlier than Oct. 23, 2003).
Acu Vibe Rechargeable Personal Massager advertisement, p. 50, Sharper Image catalog, (at least earlier than Oct. 23, 2003).
Homedics Luxury Bubbler foot bath advertisement, p. 23, JCPenny Valentines Day ad, 2003.
Homedics StyleSpa Ultra manicure/pedicure system or Infra-Tech massager advertisement, p. 23, JCPenny Valentines Day ad, 2003.
Homedics ParaSpa Elite Paraffin and Therpist Action Massager advertisement, p. 23, JCPenny Valentines Day ad, 2003.
Homedics Foot Salon Ultra advertisement, p. 23, JCPenny Valentines Day ad, 2003.

* cited by examiner

INTEGRATED REMOTE CONTROL AND MASSAGE DEVICE

BACKGROUND OF THE INVENTION

1. The Field of the Invention

The present invention relates to remote control units for electronic entertainment devices and vibrating massage devices.

2. The Relevant Technology

Home entertainment systems typically include several components such as a television, an audio system, a video disc player, a video cassette recorder, a direct broadcast satellite receiver, a personal video recorder, a cable box, and a stereo or surround sound receiver. Almost invariably, with each device, the manufacturer will provide a remote control unit for use with that device. Universal remote control units have gained popularity for use in remotely controlling the components of a home entertainment system. The universal remote control generally allows the user to control the various devices with just one remote control, eliminating or reducing the need for the user to keep and use a separate remote control for each device.

Massage devices are often used to release muscle tension and stress. They often include moving or vibrating massage surfaces which the user may use to apply pressure or vibration to the back, shoulders, arms, legs, neck, head, or other body parts of the user or another person. A convenient time to use a massage device is while relaxing in front of the television with a spouse or friend or while listening to music.

It would be an improvement in the art to reduce the number of devices needed to both control a person's electronic entertainment devices and give a massage.

BRIEF SUMMARY OF THE INVENTION

The present invention is directed to an integrated remote control and massage device. The integrated remote control and massage device comprises a housing having at least one massage surface, a remote control input interface for enabling a user to control one or more electronic entertainment devices, and at least one motor for providing vibrating movement to the massage surface of the housing.

The housing of the device may be of any suitable configuration. It includes at least one massage surface, and may be configured so as to allow the attachment and interchangeability of additional massage surfaces.

The remote control input interface enables the user to control one or more electronic entertainment devices. Examples of entertainment devices that may be controlled include a television, an audio system, a video disc player, a video cassette recorder, a direct broadcast satellite receiver, a personal video recorder, and a cable box. Entertainment devices may also include digital portable music and/or entertainment systems (e.g., mp3 players, portable CD or DVD players, PDA devices, etc.). The input interface includes an input device or means, which in one embodiment comprises a touch pad. The touch pad or other input means is electrically connected to a printed circuit board and a transmitter. The input interface may use infrared and/or radio frequency communication to control the various entertainment devices. The device may include one or more light sources for illuminating the touch pad or other input of the interface, making operation more convenient in the dark.

The integrated remote control and massage device includes at least one motor for powering the massage surface or surfaces. The one or more motors may be electric powered motors, as known in the art. The one or more motors interact with the massage surface or surfaces situated on the housing in order to vibrate the surfaces so as to provide massaging action to any of various body parts. In one embodiment, the motor is connected to an eccentric cam which transfers rotational movement provided by the motor into vibrational or oscillating movement of the massage surface or surfaces of the device. According to one embodiment, the cam rotates around a central axis such that movement is perpendicular to the axis. According to another embodiment, cam movement is along a central axis such that movement is parallel to the axis.

In one embodiment, all power required by the integrated device is provided by a battery pack. Disposable or rechargeable batteries may be used. In an embodiment including rechargeable batteries, the batteries may be packaged as a battery pack and the integrated device may include an onboard battery charger. Alternatively, the device may include an AC input or an AC/DC adapter. Power to drive the motor may be derived from the AC input or AC/DC adapter while the power may simultaneously be used to charge rechargeable batteries.

The integrated device may include one or more removable massage attachments. The massage attachments can have varying size, shape, and contour to provide greater versatility to the massager. The attachments may be rigid or soft, they may be interchangeable, and they may include one or more heating elements embedded within the massage attachments.

The integrated remote control and massage device may include various features, such as (1) heating elements that can provide heat instead of or while giving a massage, (2) a "device locator" feature, e.g., an audible or visible response (e.g., beep and/or flash) to a user's hand clap or other input, or query, (3) a built in sound recorder, and (4) a built in flash light.

These and other benefits, advantages and features of the present invention will more fully apparent from the following description and appended claims, or may be by the practice of the invention as set forth hereinafter.

BRIEF DESCRIPTION OF THE DRAWINGS

In order that the manner in which the above recited and other benefits, advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

I. Introduction

Figure 1:
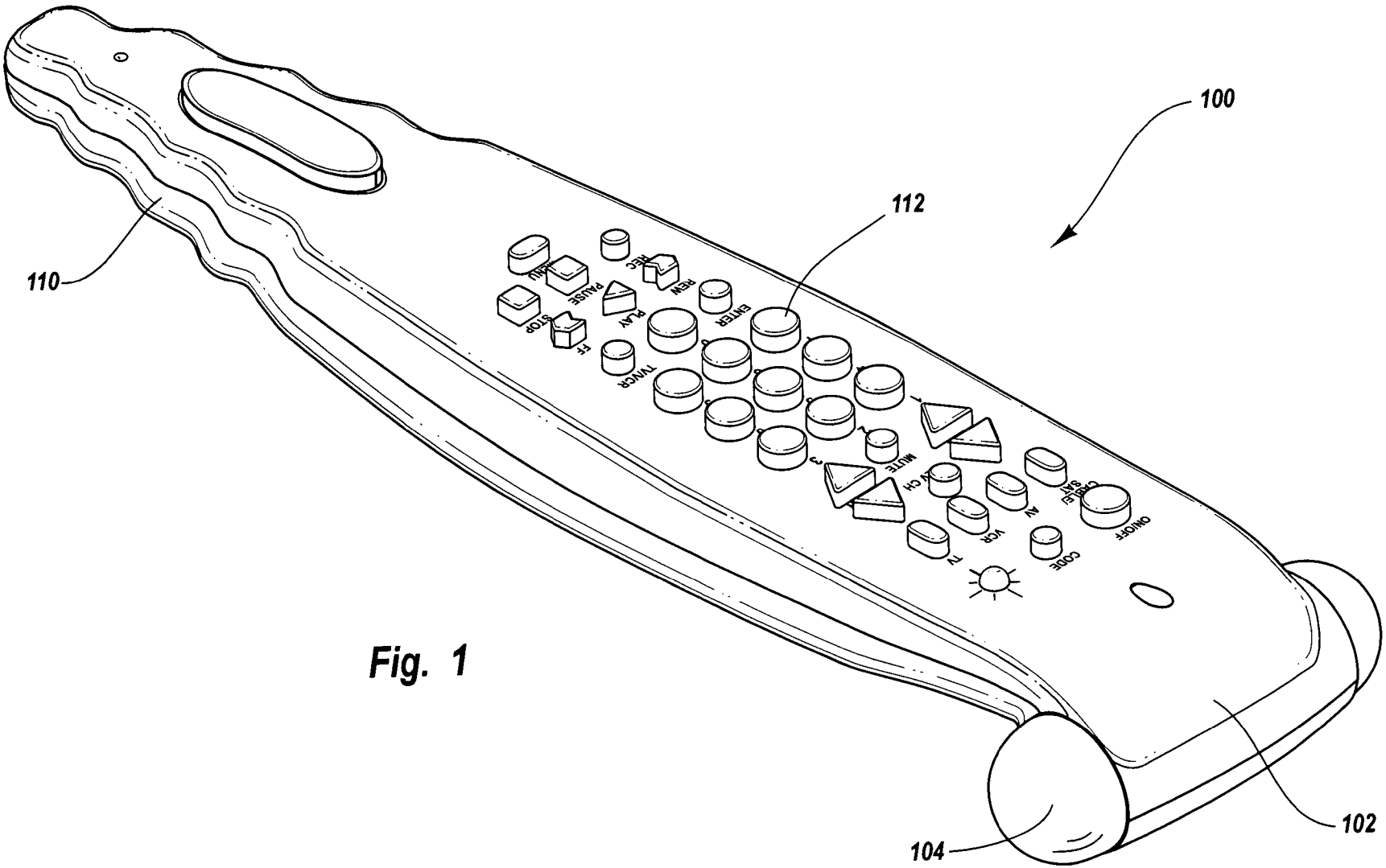
FIG. 1 is a perspective view of an exemplary integrated remote control and massage device.
Figure 2:
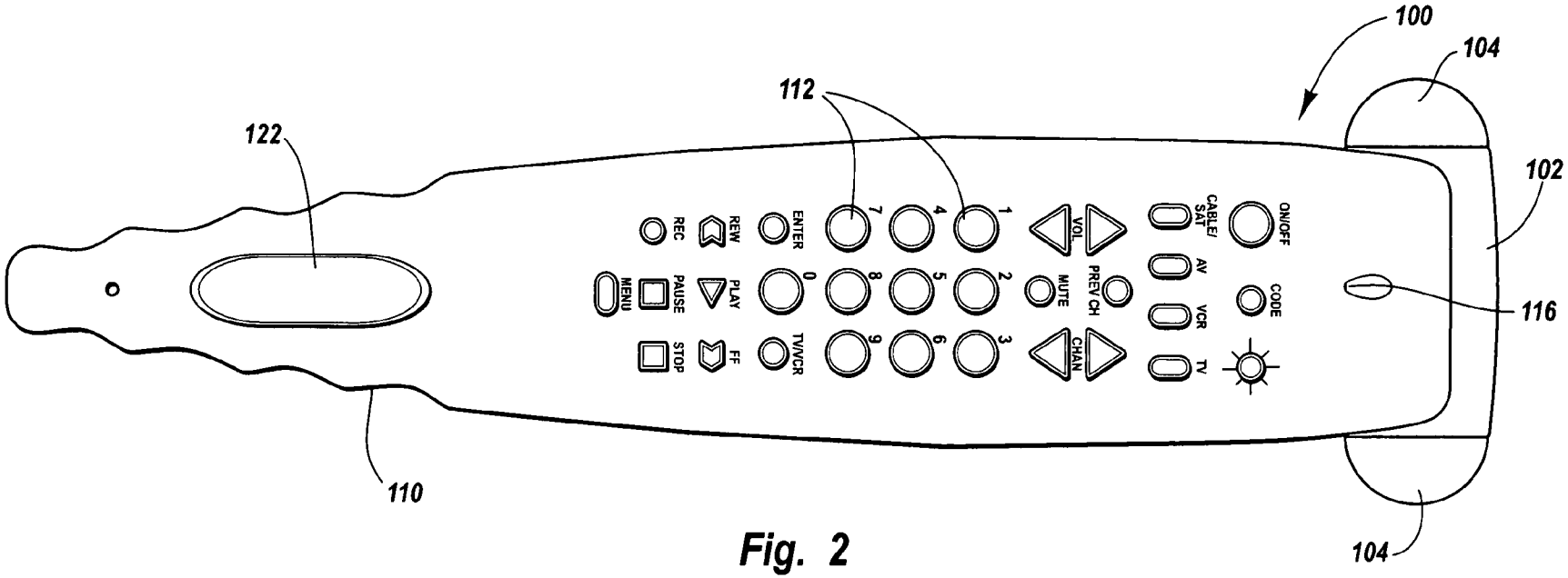
FIG. 2 is a top view of the integrated remote control and massage device illustrated in FIG. 1.
Figure 3:
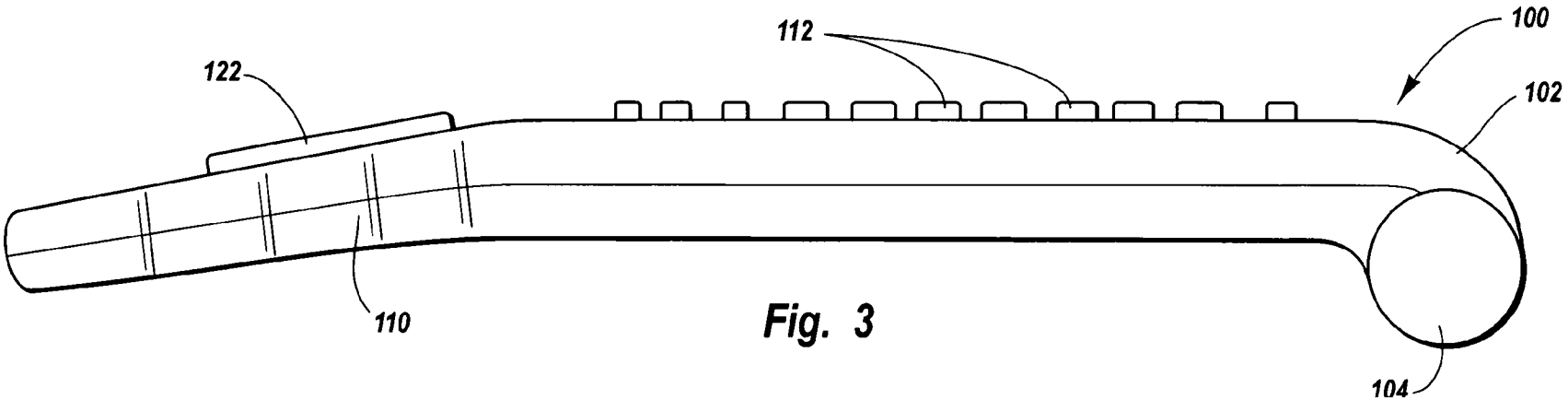
FIG. 3 is a side view of the integrated remote control and massage device illustrated in FIG. 1.

A detailed description of the invention will now be provided with specific reference to Figures illustrating preferred embodiments of the invention. It will be appreciated that like structures will be provided with like reference designations. To provide context for interpreting the scope of the invention, certain terms used throughout the application will now be defined.

As used herein, the term "remote control" refers to a device that allows the user to control one or more electronic entertainment devices from a distance. Such a device generally includes an input interface such as a touch pad, push buttons, switches, or a touch screen where the user initiates commands that are transmitted to the electronic entertainment device being controlled. Commands may be transmitted by any electromagnetic communication, for example infrared, radio frequency (including, for example, Bluetooth®), light spectrum frequencies, or any other wireless communication.

In one aspect, the present invention is directed to an integrated remote control and massage device. The integrated device provides a user the functionality of a remote control while at the same time providing a vibrating massage surface that can be used to massage the back, shoulders, arms, legs, neck, head, or other body parts. The integrated remote control and massage device comprises a housing having at least one massage surface, a remote control input interface for enabling a user to control a plurality of electronic entertainment devices, and at least one motor for providing vibrating movement to the massage surface or surfaces.

II. Exemplary Integrated Remote Control and Massage Device

FIGS. 1–4 illustrate an exemplary integrated remote control and massage device 100. The integrated device includes a housing 102 having at least one massage surface 104, a universal remote control input interface 106, and at least one motor 108 (shown in FIG. 4).

A. Housing

The housing 102 of the integrated device 100 may be of a configuration easily gripped by the user. For example, it may include a gripable portion 110 including ribs to facilitate gripping of the gripable portion by a user's hand. If present, at least a portion of the gripable portion 110 is preferably formed of a plastic or thermoplastic elastomer (e.g., natural rubber) so as to be more comfortable in the user's hand. The housing 102 may also be sealed so as to prevent or inhibit water, beverages, massage oil, or other liquids from entering the device 100.

B. Universal Remote Control Input Interface

The universal remote control input interface 106 includes input means which may include a touch pad 112 for enabling a user to control one or more electronic entertainment devices. Alternatively, input means may comprise push buttons, switches, or a touch screen. Touch pad 112 is communicatively connected to processor 114 and transmitter 116. In one embodiment, processor 114 is a printed circuit board. Transmitter 116 may be an infrared and/or radio frequency transmitter or other appropriate electromagnetic transmitting means. Various ways of communicatively connecting the input means, processor and transmitter will be known to those skilled in the art.

C. Motor

Figure 4:
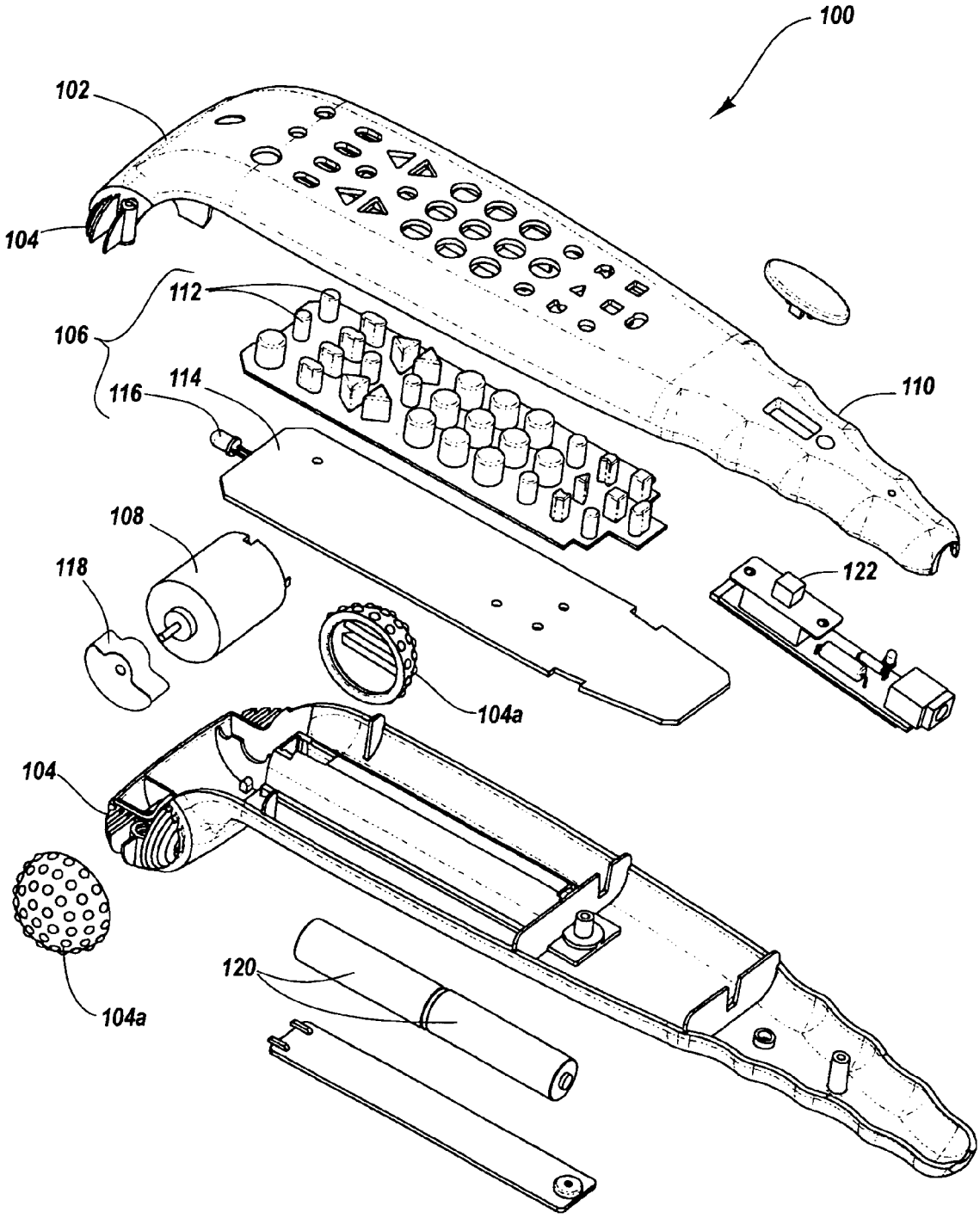
FIG. 4 is an exploded assembly view of the integrated remote control and massage device illustrated in FIG. 1.

The integrated remote control and massage device 100 includes at least one motor 108 for providing vibrating movement to the massage surface or surfaces 104. The motor may be an electric powered motor, as illustrated in FIG. 4. In an alternate embodiment, an induction coil may be used as the motor. In the illustrated embodiment, the motor 108 may provide vibrating movement to massage surface 104 by creating rotational movement and transferring the rotational movement to an eccentric cam 1118. The rotational movement is transformed into vibrational movement by the imbalanced motion of the eccentric cam 118. These vibrations are transferred through contact between the cam 118 through the housing 102 attached to the massage surface 104, thereby causing massage surface 104 to vibrate. In actuality, the vibrating motion results from a constantly changing momentum vector created by the imbalanced angular rotation of the eccentric cam. The vibrating surface 104 is useful for massaging the back, shoulders, arms, legs, neck, head, or other body parts of the user or another person.

In a preferred embodiment, the device 100 may include at least one chamber and an electronic interface that allows the device 100 to operate using one or more batteries 120. Batteries 120 may be disposable or rechargeable. In one embodiment, batteries 120 comprise two or more 600 mAh Nickel Cadmium (Ni—Cd) 1.2 V "AA" size batteries. Other Ni—Cd or Nickel Metal Hydride (Ni—MH) rechargeable batteries or disposable batteries (e.g. alkaline batteries), or even an alternative power storage device (e.g. fuel cells) can alternatively be used.

In an embodiment including rechargeable batteries, the batteries may be packaged in plastic or other material as a battery pack, and the integrated device 100 may include an onboard or detached battery charger (e.g., a charging docking station). One such suitable device would be any UL listed class 2 power unit. Standard connections between the battery charger, the batteries, the printed circuit board, and the motor are known to those skilled in the art.

As illustrated in FIG. 4, in one embodiment the motor 108 may be controlled by a switch 122. In one embodiment, switch 122 is a 3-way, 2 pole slider switch. The three positions may, for example, correspond to motor speeds of "off," "low," and "high." In one embodiment, switch 122 may be configured so that when active, the input interface 106 deactivates control over the electronic entertainment device(s). This prevents inadvertent commands from being sent by the integrated device 100 to an electronic entertainment device while the device 100 is being used in the massage mode. Alternatively, any type of electronic or mechanical (e.g., push button) switch could be used.

The integrated remote control and massage device 100 may optionally include a "device locator" feature, such as an audible or visible response (e.g., beep and/or flash) to a user's hand clap, phone call, or other input or query. Such a feature allows the user to quickly and easily locate the integrated device 100 if it has been misplaced. In such an embodiment, the integrated device may include a receiver for receiving an electronic or audible input. The receiver is communicatively connected to an audible or visible response device, such as a speaker or a flashing light source (not shown). When an appropriate signal is received, the speaker may beep or the light source may flash.

D. Massage Surface Attachments

Figure 5B:
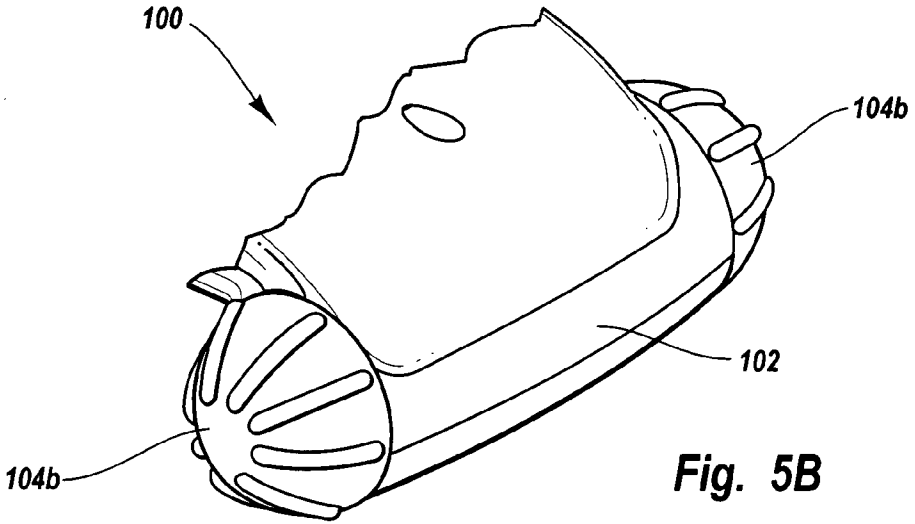
FIG. 5B is a partial side view of an exemplary integrated remote control and massage device including an interchangeable massage surface having raised ribs.
Figure 5A:
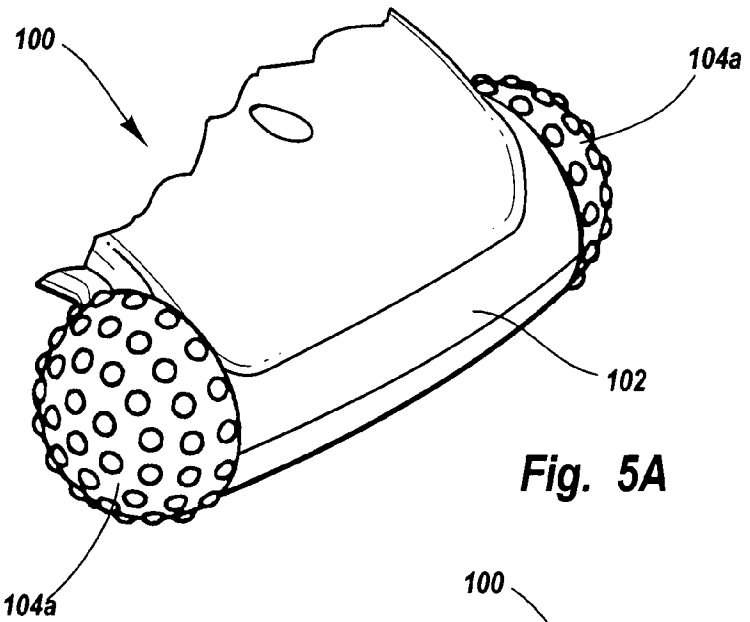
FIG. 5A is a partial side view of an exemplary integrated remote control and massage device including an interchangeable massage surface having raised bumps.
Figure 5C:
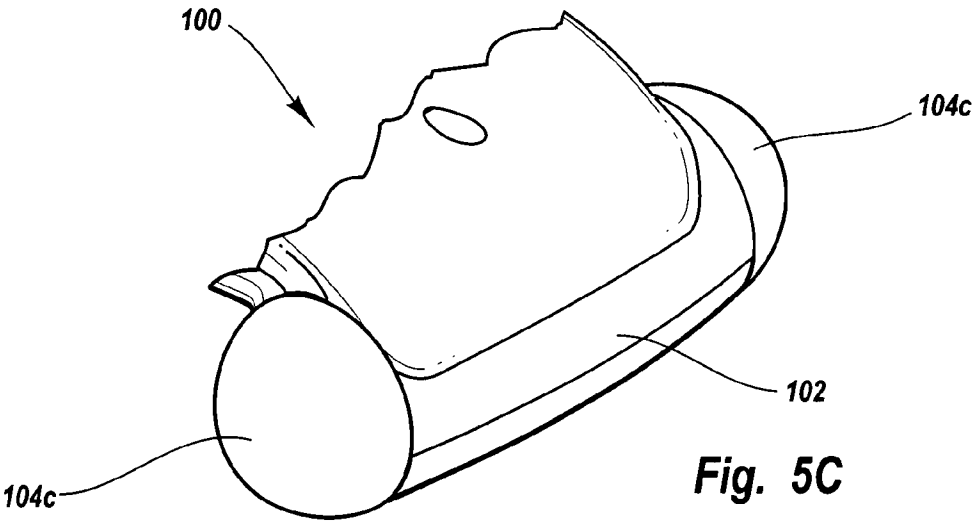
FIG. 5C is a partial side view of an exemplary integrated remote control and massage device including an interchangeable massage surface having a smooth surface.

The integrated remote control and massage device 100 may include one or more removable and interchangeable massage surface attachments. The massage attachments can have varying size, shape, and contour to provide greater versatility to the massager. Referring to FIGS. 5A–5C, various exemplary massage attachments 104*a*–104*c* are shown. Each massage attachment is configured to be interchangeably attachable to massage surface 104 of housing 102. The attachments may attach by a snap fit, a friction fit, a threaded connection, a bayonet connection, or other engagement means known in the art. In the illustrated embodiment, the attachments 104*a*–104*c* are hemispherical in shape. Attachment 104*a* includes raised bumps along the outside surface of attachment 104*a*. Attachment 104*b* includes raised ribs along the outside surface. Attachment 104*c* exhibits a smooth outer surface.

Any portion of the housing 102, massage surface 104 or attachments may further include one or more heating elements that selectively provide heat to the massage surface and area to be massaged. The heating element may be an infra-red (IR) heating element or a resistive heating element. The heating element may be electrically connected to batteries 120 by any electrical connection known to those skilled in the art. Alternatively, it may be desirable to include an AC power input or an AC/DC adapter in order to provide power to the one or more heating elements. Such an embodiment may be especially useful to prolong battery life while using the integrated device in a massage and/or heating mode.

The massage surface(s) 104 or attachments may be rigid or soft. Preferably, the massage surface 104 or attachments are formed of a shore A material having a durometer hardness of between about 30 and about 90, more preferably between about 40 and about 80, and most preferably about 50 to about 70.

Figure 6:
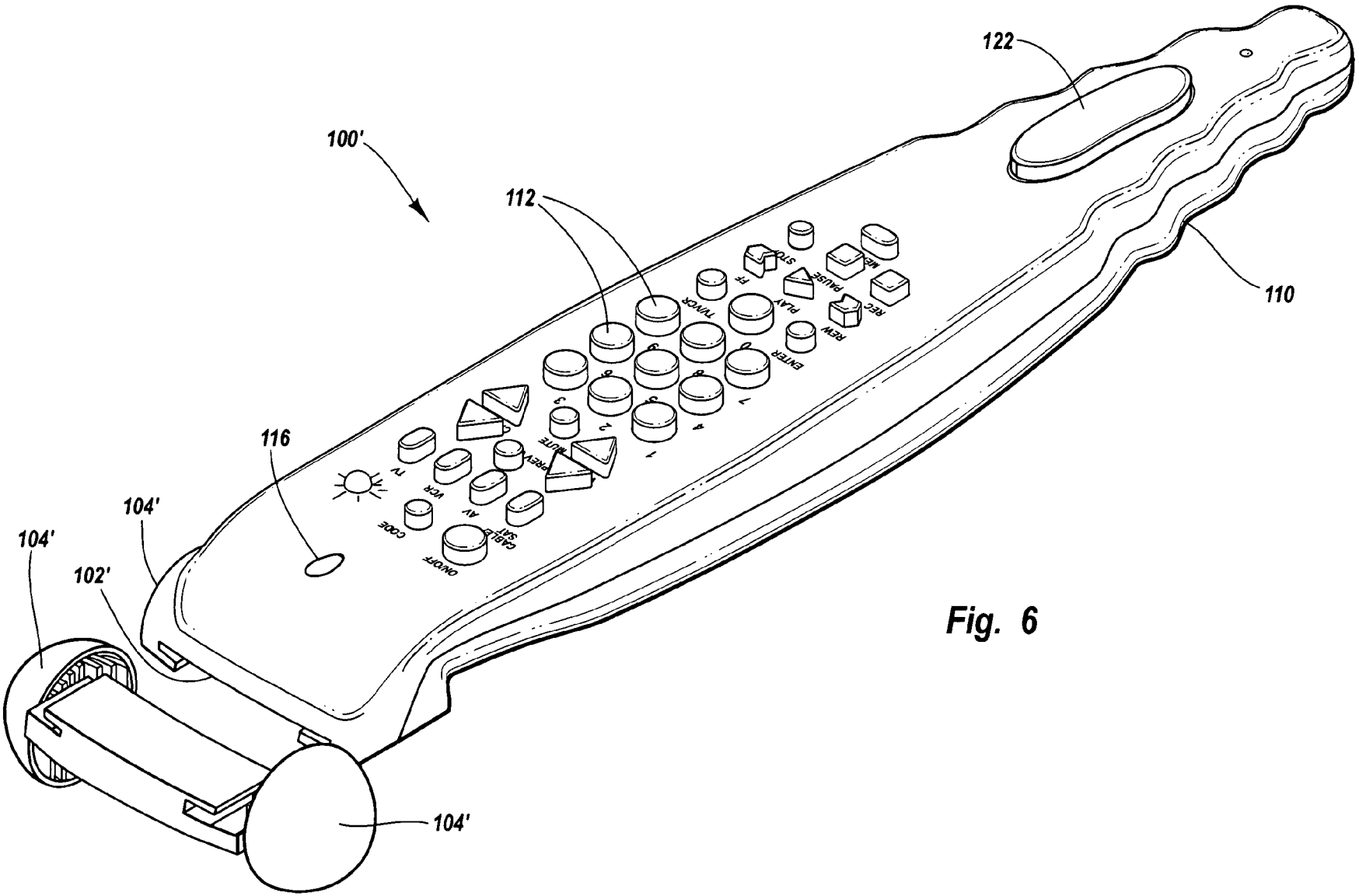
FIG. 6 is a perspective view of an exemplary embodiment of an integrated remote control and massage device including a detachable massage surface.

Referring to FIG. 6, an alternative embodiment of the integrated remote control and massage device 100' includes a detachable massage surface 104' which may be attachable and detachable from housing 102'. Massage surface 104' may be attachable by a slide fit, a snap fit, or any other locking engagement known in the art.

Figure 7:
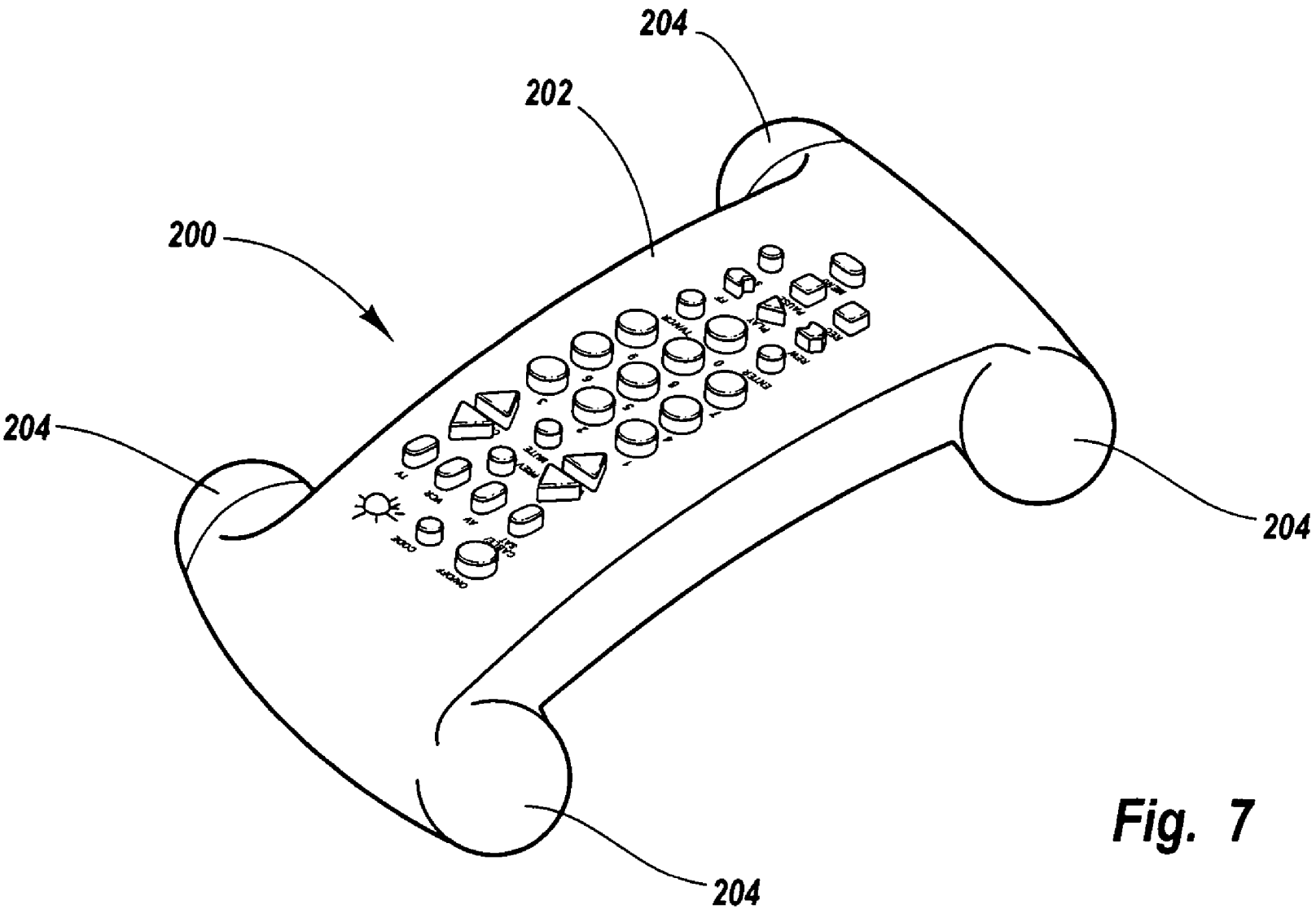
FIG. 7 is a perspective view of an exemplary embodiment of an integrated remote control and massage device that includes massage surfaces at each end of the integrated device.

FIG. 7 illustrates an alternative embodiment of an integrated remote control and massage device 200 that includes massage surfaces 204, on opposite sides of the massage device 200. In this embodiment, a pair of massage surfaces 204 are situated at each end of the integrated device 200.

III. Other Integrated Remote Control Devices

A. Integrated Remote Control and Flashlight

Figure 8A:
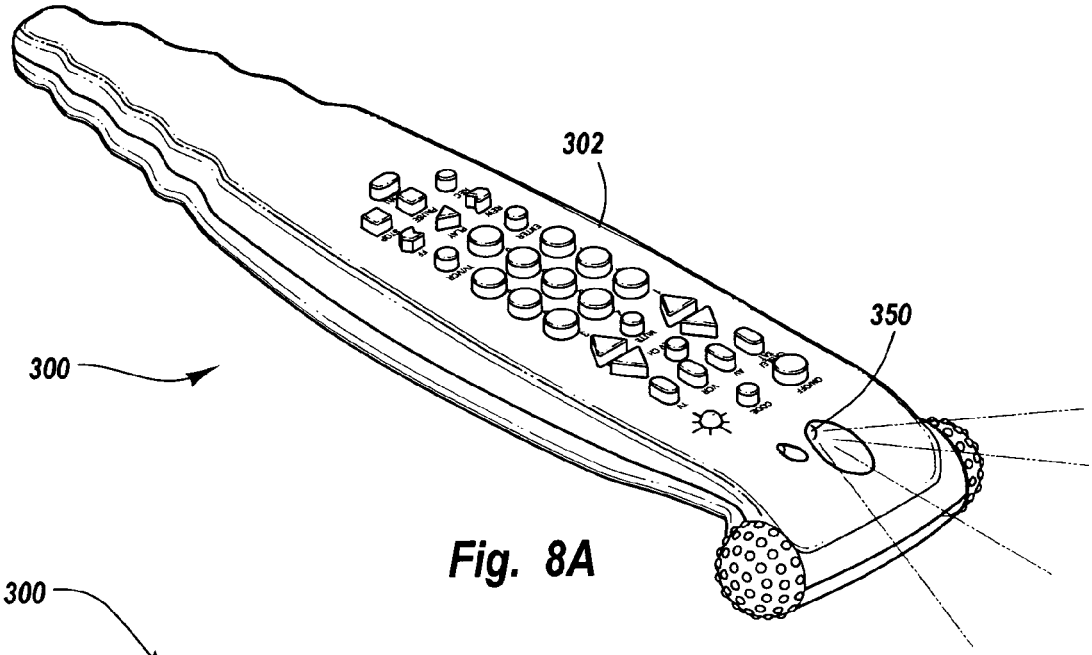
FIG. 8A is a perspective view of an exemplary integrated remote control and flashlight.
Figure 8B:
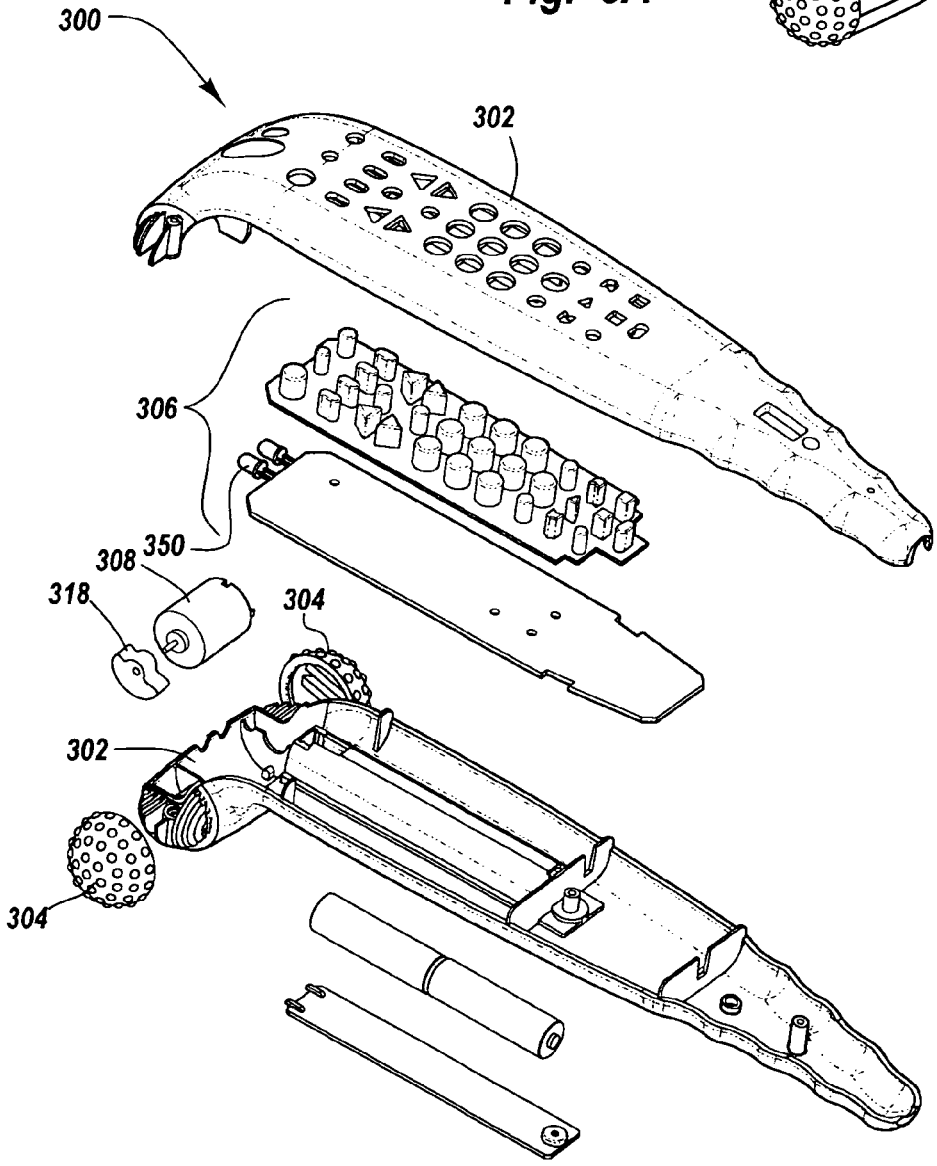
FIG. 8B is an exploded assembly view of the device illustrated in FIG. 8A.

FIGS. 8A and 8B illustrate an alternative embodiment of an integrated remote control device 300 incorporating a flashlight. Integrated device 300 includes a housing 302, a remote control input interface 306, and a light source 350 configured to be used as a flashlight. The light source may comprise an LED, incandescent bulb, halogen bulb, fluorescent bulb, or other suitable light source. According to one embodiment, the light source may comprise a plurality of LEDs (other light sources could also be used) arranged in a circular pattern with a focusing lens (not shown). The lens may be rotated in order to narrowly focus or widen the light emitted from the light source. The integrated device 300 may also include a massage surface 304 and a motor 308, as described above.

B. Integrated Remote Control and Recording Device

Figure 9A:
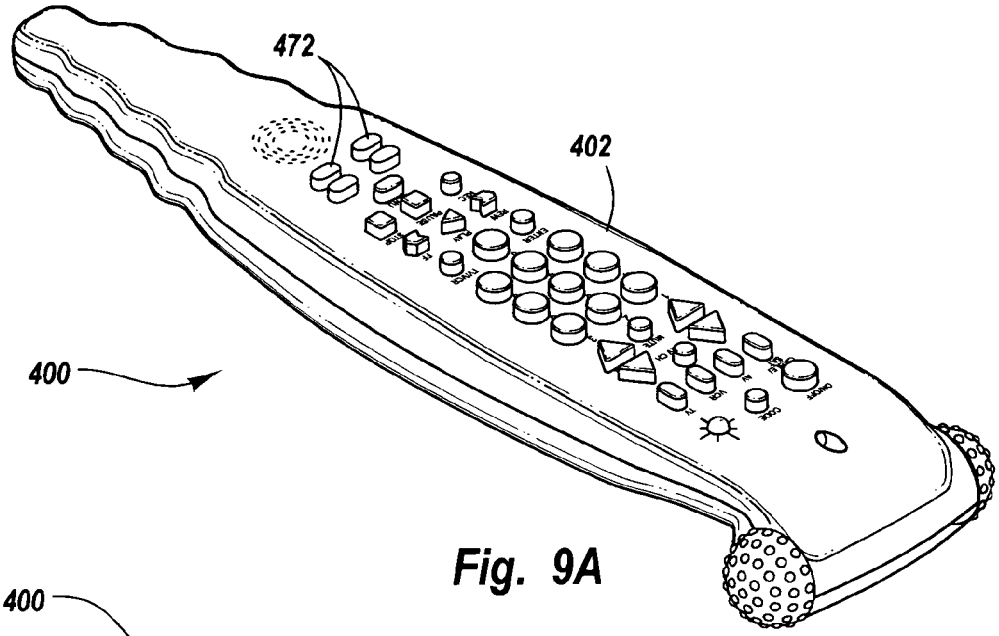
FIG. 9A is a perspective view of an exemplary integrated remote control device and a sound recorder.
Figure 9B:
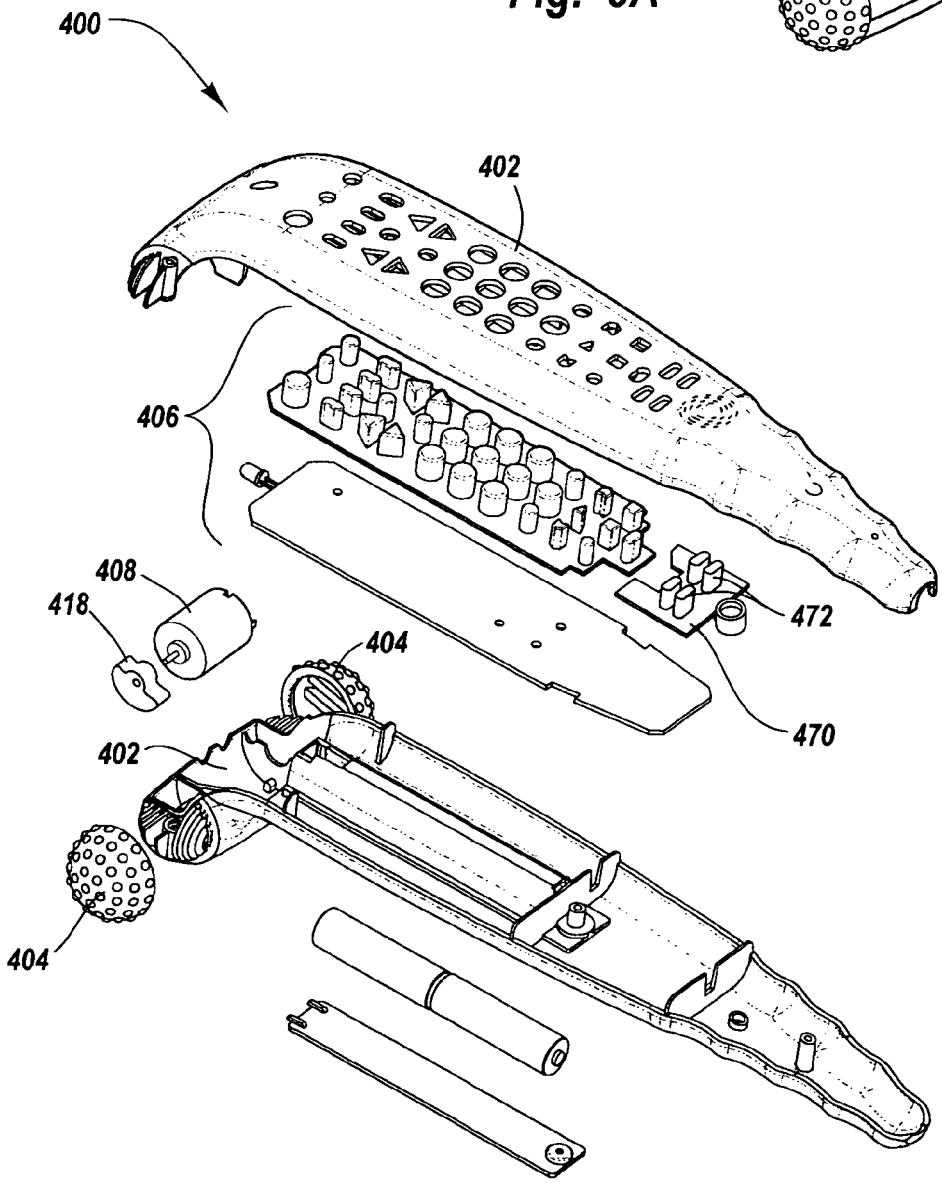
FIG. 9B is an exploded assembly view of the device illustrated in FIG. 9A.

FIGS. 9A and 9B illustrate an alternative embodiment of an integrated remote control device 400 incorporating a recording device. Integrated device 400 includes a housing 402, a remote control input interface 406, and a sound recorder 470. The sound recorder 470 may comprise a memory device (e.g., a mini audio tape or a digital audio storage device).

The memory device may have a capacity as large or small as desired for a desired play-back duration. For short messages, the memory device may allow for sound recordings of up to about 20, 40 or 60 seconds per message.

The integrated remote control device 400 preferably includes one or more activation switches for controlling sound recorder 470. Buttons 472 are examples of suitable activation switches for controlling sound recorder 470. Sound recorder 470 may be used to store, for example, music to be played back during use of the massage mode to induce relaxation. For example, buttons 472 may include buttons to allow the user to play, fast forward, fast reverse, and record. The integrated device 400 may also include a massage surface 404 and a motor 408, as described above. According to one embodiment, the integrated device 400 may include an interlock feature that prevents use of the remote control function until the recorded sound has been played back.

C. Integrated Remote with Touch Screen Interface and Massage Device

Figure 10:
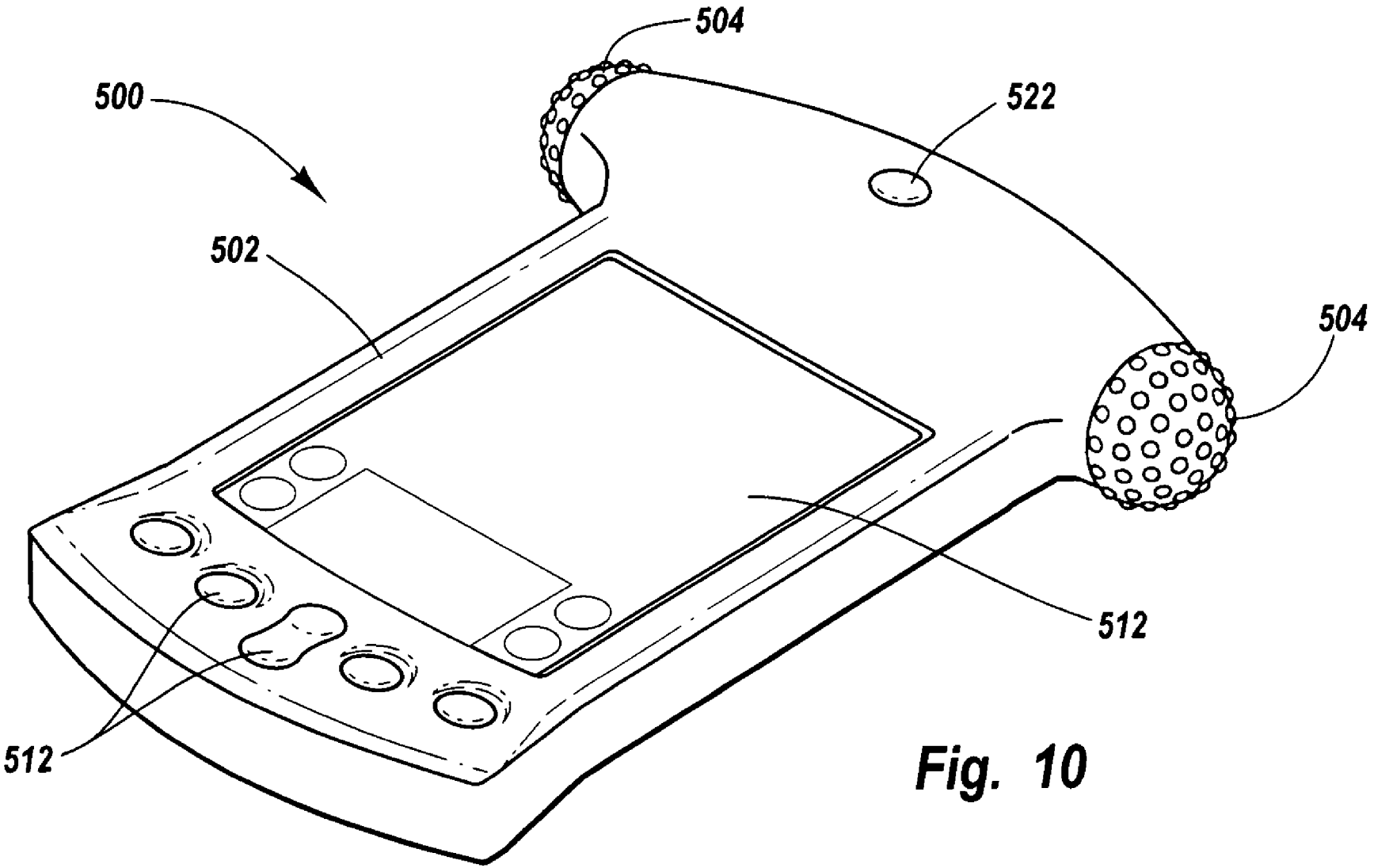
FIG. 10 is a perspective view of an exemplary integrated remote control device and a massage device, the remote control device having a dynamic touch screen interface.

For some people who are PDA savvy, providing a remote control device having a touch screen interface might be especially desirable. FIG. 10 illustrates an embodiment of an integrated remote control device 500 having a touch screen interface and massage device. Integrated device 500 includes a housing 502 having at least one massage surface 504, an input interface (only the touch screen and auxiliary buttons 512 are shown), and at least one motor (not seen). The housing 502 may be of a configuration that is easily held and gripped by the user. The input interface includes input means 512 that may include any desired combination of buttons, keys, or a touch screen. The buttons, keys, touch screen, or other input means 512 may be backlit, and are communicatively connected to a processor (not seen). The processor may be a printed circuit board. In addition to being used as a remote control device, the integrated device 500 may also optionally include other capabilities (e.g., a cordless phone, an audio recorder or a PDA).

The integrated device 500 includes a motor (not seen) for providing vibrating movement to the one or more massage surfaces 504. According to one embodiment, activation of the motor may be controlled by the input means 512 (e.g., button, key, or touch screen). Alternatively, the motor may be activated by an optional separate switch 522 (e.g., similar to switch 122).

Massage surface 504 may be such that it may be interchangeable with various other massage attachments varying in size, shape, and contour to provide greater versatility to the massager. For example attachments such as those illustrated in FIGS. 5A–5C may be used. Any portion of the housing 502, massage surface 504 or attachments may further include one or more heating elements for selectively providing heat to the massage surface and the area to be massaged. The heating element may be an IR heating element or a resistive heating element. The integrated device, including the heating element, may be powered by batteries (e.g., disposable or rechargeable), by AC current, fuel cell, or by any electrical connection known to those skilled in the art.

Figure 11:
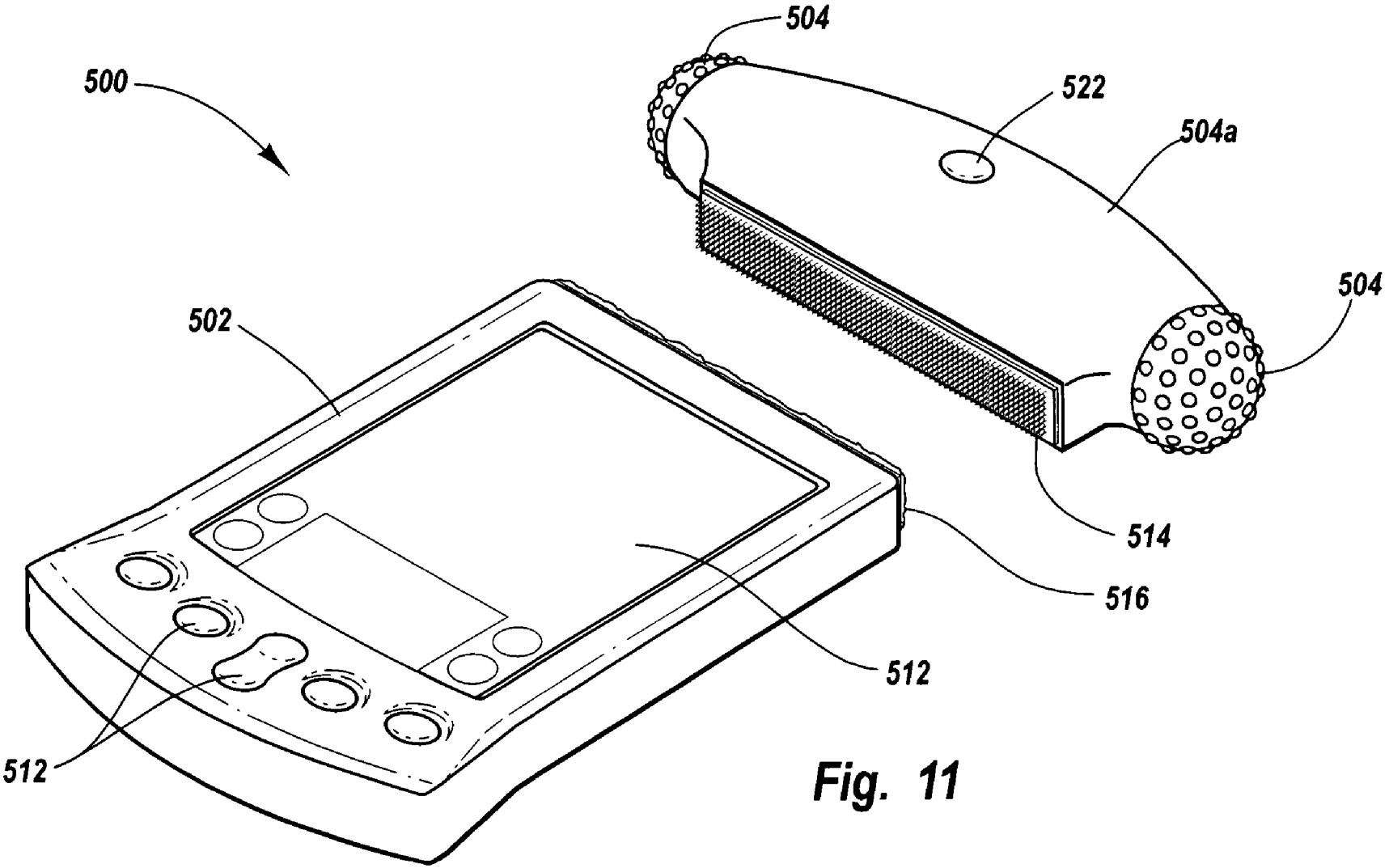
FIG. 11 is a perspective view of an exemplary massage device that is selectively attachable to an existing remote control device.

As illustrated in FIG. 11, according to one embodiment, a detachable massage device 504*a* may be attachable to a housing 502 of an existing remote control device. Massage device 504*a* may be attachable by a hook and loop material (e.g., Velcro®), tape, or another adhesive. The illustrated example includes a strip of hook material 514 and a strip of loop material 516, each strip being glued or otherwise adhered to a respective housing 502 and the massage device 504*a*.

It will also be appreciated that the present claimed invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A hand-held integrated remote control and massage device, comprising:

a housing including at least one massage surface;

a remote control input interface for enabling a user to control at least one electronic entertainment device; and at least one motor located at least partially within said housing for providing vibrating movement to said massage surface.

2. A hand-held integrated remote control and massage device as recited in claim 1, wherein said input interface enables control of one or more of a television, an audio system, a video disc player, a video cassette recorder, a direct broadcast satellite receiver, a personal video recorder, a cable box, digital portable music or portable entertainment systems.

3. A hand-held integrated remote control and massage device as recited in claim 1, wherein said input interface enables control of at least one electronic entertainment device by an electromagnetic communication.

4. A hand-held integrated remote control and massage device as recited in claim 1, further comprising at least one light source that selectively illuminates said input interface.

5. A hand-held integrated remote control and massage device as recited in claim 1, wherein said input interface comprises a touch screen.

6. A hand-held integrated remote control and massage device as recited in claim 1, wherein said input interface comprises a touch pad or buttons.

7. A hand-held integrated remote control and massage device as recited in claim 1, further comprising a device locator.

8. A hand-held integrated remote control and massage device as recited in claim 7, wherein said device locator comprises a receiver and one of a speaker or a flashing light source.

9. A hand-held integrated remote control and massage device as recited in claim 1, wherein said housing further comprises a gripable portion including ribs that facilitate gripping of the gripable portion by a user's hand.

10. A hand-held integrated remote control and massage device as recited in claim 9, wherein at least a portion of said gripable portion comprises at least one of plastic or thermoplastic elastomer.

11. A hand-held integrated remote control and massage device as recited in claim 1, wherein said input interface includes a switch for activating said at least one motor for providing vibrating movement to said massage surface.

12. A hand-held integrated remote control and massage device as recited in claim 11, wherein said remote control input interface deactivates control over said electronic entertainment device while said at least one motor is active in order to avoid sending inadvertent commands.

13. A hand-held integrated remote control and massage device as recited in claim 1, wherein at least a portion of said massage surface comprises one or more removable massage attachments.

14. A hand-held integrated remote control and massage device as recited in claim 1, further comprising at least one heating element that selectively provides heat to said massage surface.

15. A hand-held integrated remote control and massage device as recited in claim 14, said heating element comprising at least one infra-red device.

16. A hand-held integrated remote control and massage device as recited in claim 1, wherein said housing is sealed so as to prevent or inhibit water or other liquids from entering the device.

17. A hand-held integrated remote control and massage device as recited in claim 1, further comprising at least one chamber and electronic interface that allows the device to operate using one or more disposable batteries.

18. A hand-held integrated remote control and massage device as recited in claim 1, further comprising at least one rechargeable battery.

19. A hand-held integrated remote control and massage device as recited in claim 1, further comprising a flashlight at least partially enclosed within said housing.

20. A hand-held integrated remote control and massage device as recited in claim 19, wherein said flashlight comprises one or more LEDs.

21. A hand-held integrated remote control and massage device as recited in claim 1, further comprising a sound recorder at least partially enclosed within said housing.

22. A hand-held integrated remote control and massage device as recited in claim 21, wherein said sound recorder comprises at least one memory device and at least one activation switch.

23. A hand-held integrated remote control, massage and sound recording device, comprising:

a housing including at least one massage surface;

a remote control input interface, at least partially enclosed within said housing, that enables a user to selectively control at least one electronic entertainment device;

at least one motor located at least partially within said housing for providing vibrating movement to said massage surface; and a sound recorder at least partially enclosed within said housing.

24. A hand-held integrated remote control, massage and flashlight device, comprising:

a housing including at least one massage surface;

a remote control input interface, at least partially enclosed within said housing, that enables a user to selectively control at least one electronic entertainment device; at least one motor located at least partially within said housing for providing vibrating movement to said massage surface; and a flashlight at least partially enclosed within said housing.

* * * * *